United States Patent [19]

Kreinberg et al.

[11] 4,414,765

[45] Nov. 15, 1983

[54] STEAM MANGLE WITH HEAT RECYCLING TO PREDRYER

[75] Inventors: Manfred Kreinberg, Vlotho; Lothar Petzold, Bad Salzuflen, both of Fed. Rep. of Germany

[73] Assignee: Herbert Kannegiesser GmbH & Co., Vlotho, Fed. Rep. of Germany

[21] Appl. No.: 242,211

[22] Filed: Mar. 10, 1981

[30] Foreign Application Priority Data

Nov. 3, 1980 [DE] Fed. Rep. of Germany ..... 3041244

[51] Int. Cl.[3] ..... D06F 65/10

[52] U.S. Cl. ..... 38/54

[58] Field of Search ..... 38/54, 55, 49, 1 R, 38/2, 7, 3

[56] References Cited

U.S. PATENT DOCUMENTS

| | | | |
|---|---|---|---|
| 1,769,010 | 7/1930 | Adams | 38/49 |
| 3,634,956 | 1/1972 | Behn | 38/1 R |

FOREIGN PATENT DOCUMENTS

| | | | |
|---|---|---|---|
| 182689 | 7/1905 | Fed. Rep. of Germany . | |
| 468074 | 10/1928 | Fed. Rep. of Germany . | |
| 600141 | 6/1934 | Fed. Rep. of Germany . | |
| 2814618 | 1/1980 | Fed. Rep. of Germany . | |
| 475285 | 11/1937 | United Kingdom . | |
| 475286 | 11/1937 | United Kingdom . | |
| 120774 | 12/1945 | United Kingdom | 38/55 |
| 689639 | 4/1953 | United Kingdom . | |
| 805339 | 12/1958 | United Kingdom . | |
| 962486 | 7/1964 | United Kingdom | 38/55 |
| 1018073 | 1/1966 | United Kingdom . | |
| 2069539 | 8/1981 | United Kingdom | 38/49 |

*Primary Examiner*—Werner H. Schroeder
*Assistant Examiner*—Andrew M. Falik
*Attorney, Agent, or Firm*—Sughrue, Mion, Zinn, Macpeak and Seas

[57] ABSTRACT

Used hot air exhausted from perforated mangle drums 12–14 and/or steam condensate from curved guide troughs 15–17 cooperating with the drums is passed through the interior of a hollow, unperforated predryer cylinder 18. A pair of curved transport belts 40, 41 surround the bottom half of the cylinder and are driven at the same peripheral speed thereof to press laundry articles against the heated cylinder and to reverse their direction. Heating manifolds 46, 47 are mounted inside the transport belt runs.

13 Claims, 3 Drawing Figures

STEAM MANGLE WITH HEAT RECYCLING TO PREDRYER

BACKGROUND OF THE INVENTION

This invention relates to a mangle for pressing damp laundry articles with rotatably mounted padded drums in the form of perforated hollow cylinders connected to a vacuum device. The drum surfaces contact and cooperate with trough shaped hollow bodies heated with high pressure steam, and the used hot air developed inside the drums and/or the condensate accumulating in the trough bodies is used to pre-dry the laundary articles.

With a known mangle the used air from the drums is used to heat a post dryer arranged behind the drums (German AS No. 1,666,740). The post dryer consists essentially of a box shaped heat chamber which works together with the laundry article transport or conveyor bands and which is heated by the used hot air. The transport bands guide the laundry articles into and press them against the heat chamber. The post dryer is arranged at the rear end of the mangle and can be folded up above the drums.

It is also known (German PS NO. 468,074) to channel the used air from the drums through a heat exchanger to heat fresh air, and then to use the warm fresh air to pre- and post-dry the laundry articles. The heated fresh air is supplied to boxes having perforated upper surfaces arranged before and after the mangle drums, and flows through the perforations to the laundry articles which are drawn thereacross.

The hot air and vapor from the drums is reused in these known mangles in order to recycle the exhaust air which would otherwise be released into the atmosphere, but such recycling is problematical in several respects. The post dryer of German AS No. 1,166,740 does not significantly increase the output of the mangle because it is not the conditions at the end but rather at the beginning of the mangle which are decisive. The post dryer also has a negative effect on the smoothing achieved by the mangle itself. When fresh air is blown freely through the laundry articles before and after the mangle, this fresh air being heated by the exhaust air from the mangle drums in a heat exchanger (German PS No. 468,074), this also adversely affects the operation of the mangle. The people working at the mangle are constantly subjected to a hot and steamy environment, and in addition the exhausted hot air from the drums is not effectively utilized.

With another known mangle (German PS No. 182,689) a drum and several trough shaped hollow bodies are spaced slightly apart, the condensate which accumulates in the hollow bodies is fed back through the tubes which serve to heat the air, and the air which is heated in this manner is applied to the laundry articles which move around the drum in the space between the drum and the hollow bodies.

With still another known mangle (German AS No. 2,814,618) having two drums situated one above the other and each having two trough shaped hollow bodies associated with it, the condensate which accumulates in the hollow bodies is taken to a heat exchanger for further heating and added to hot air already heated in a separate heat exchanger. This double heated air is then applied to the laundry articles as in German PS 182,689.

Using the hot condensate to heat air and using this heated air to dry the laundry articles in a press or mangle is disadvantageous in several respects. The utilization of the condensate heat is not optimal, for example, in the mangle of German PS No. 182,689 because a large proportion of the hot air is vented to the atmosphere as a result of the constantly running exhaust associated with the drums.

It is also known to pass the laundry articles for purposes of pre- and post-drying over the outside of the heated trough shaped hollow bodies (Great Britain No. 805,339 and German PS No. 600,141) and to press the laundry articles against the outside of the hollow bodies.

Cylinder mangles are also known in which the outer surface of a steam heated cylinder or drum is provided with pressure rollers, bands or plates which move at the same speed and in the same direction as the drum, and which guide the laundry articles and press them against the drum.

SUMMARY OF THE INVENTION

The object of this invention is to provide a mangle wherein the heat of the exhaust air and/or the condensate is used more advantageously and efficiently than with known mangles without adversely influencing the operation of the mangle.

With a mangle constructed according to the invention the heat contained in the exhaust air and/or condensate is used to heat an unperforated hollow cylinder and cooperating curved guide manifolds arranged in advance of the mangle drums relative to the direction of transport, and the laundry articles are guided around the outer wall of this cylinder and travel substantially around it. The laundry articles are dried only by contact with the heated wall surface, without the blow through of hot air, before the pressing operation, and the pre-drying process is very effective due to an increased length drying run. The laundry articles reach the first mangle drum/trough unit considerably pre-dried, which eliminates to a large extent problems when damper articles are initially fed into the mangle.

DETAILED DESCRIPTION OF THE PREFERRED EMBODIMENTS

Figure 1:
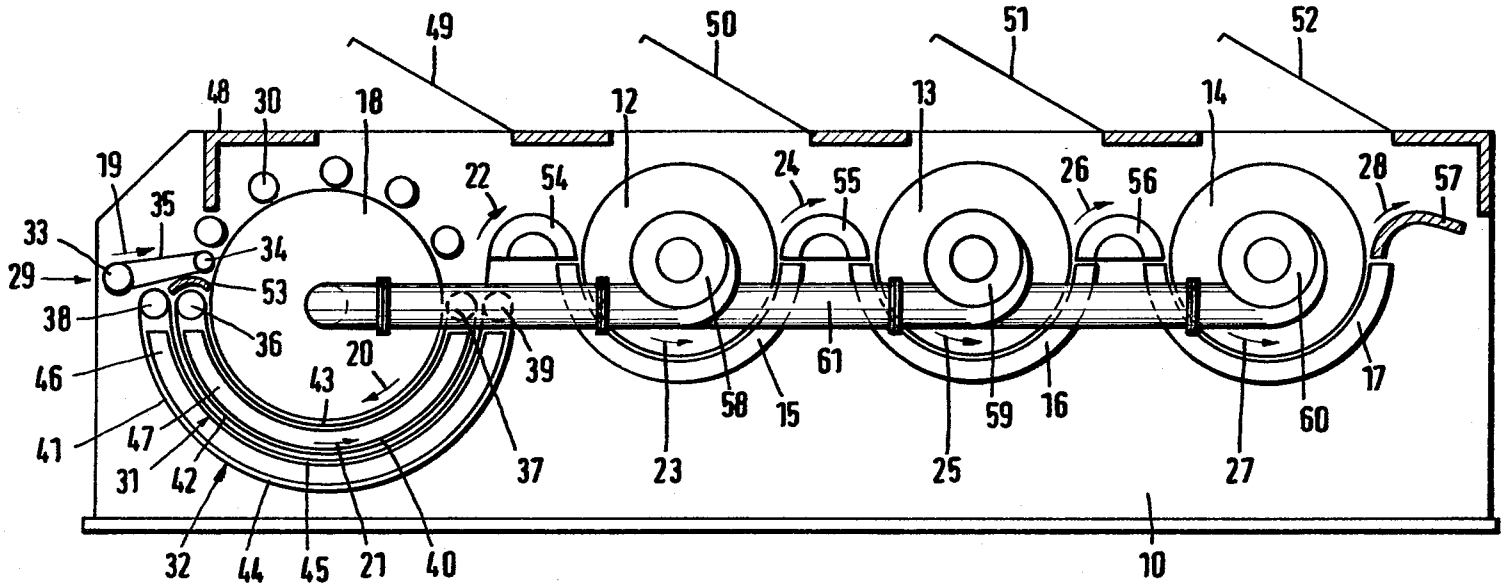
FIG. 1 shows a longitudinal sectional view through a mangle with a hollow cylinder heated by exhaust air according to the invention.

The mangle shown in the drawings consists of two spaced, vertical stands 10, 11 between which padded, air permeable drums 12, 13, and 14 are mounted. The drums cooperate with the heated working surfaces of stationary, trough shaped hollow bodies 15, 16, and 17. An unperforated but heated hollow padded cylinder 18 is mounted in advance of drum 12. The drums and cylinder are rotatably mounted in the stands 10, 11 in a known manner, not illustrated, to revolve in the direction of arrows 20, 23, 25, 27. A driven belt infeed 29 is also mounted between the stands in front of the cylinder 18, as are five pressure rollers 30 spaced around the upper periphery of the cylinder and a pair of curved pressure plates 31, 32. The infeed 29 consists of two drive and diverting rollers 33, 34 and a plurality of belts 35 which fit around them. The two pressure plates 31, 32 consist of drive and diverting rollers 36–39 and transport bands 40, 41 which enclose heated guide manifolds 46, 47. The four runs 42–45 of the transport bands are driven such that the laundry articles are conveyed between the runs 42, 45 and the heated manifolds 46, 47. The infeed 29 and the pressure plates 31, 32 are driven in the direction of arrows 19, 20, and 21. The transfer of the laundry articles from the first transport section of plate 31 to the second transport section formed in common with plate 32 is accomplished by a diverter guide 53. The transfer of the articles from between the two pressure plates 31, 32 to the first drum/trough unit 12, 15, and then through the following units 13, 16 and 14, 17 is implemented by curved diverter bridges 54, 55, 56, which are heated with high pressure steam as are the troughs 15–17 and the manifolds 46, 47. Following the last drum/trough unit is a feed out tray 57 which transfers the laundry articles to a table or folding machine.

Figure 2:
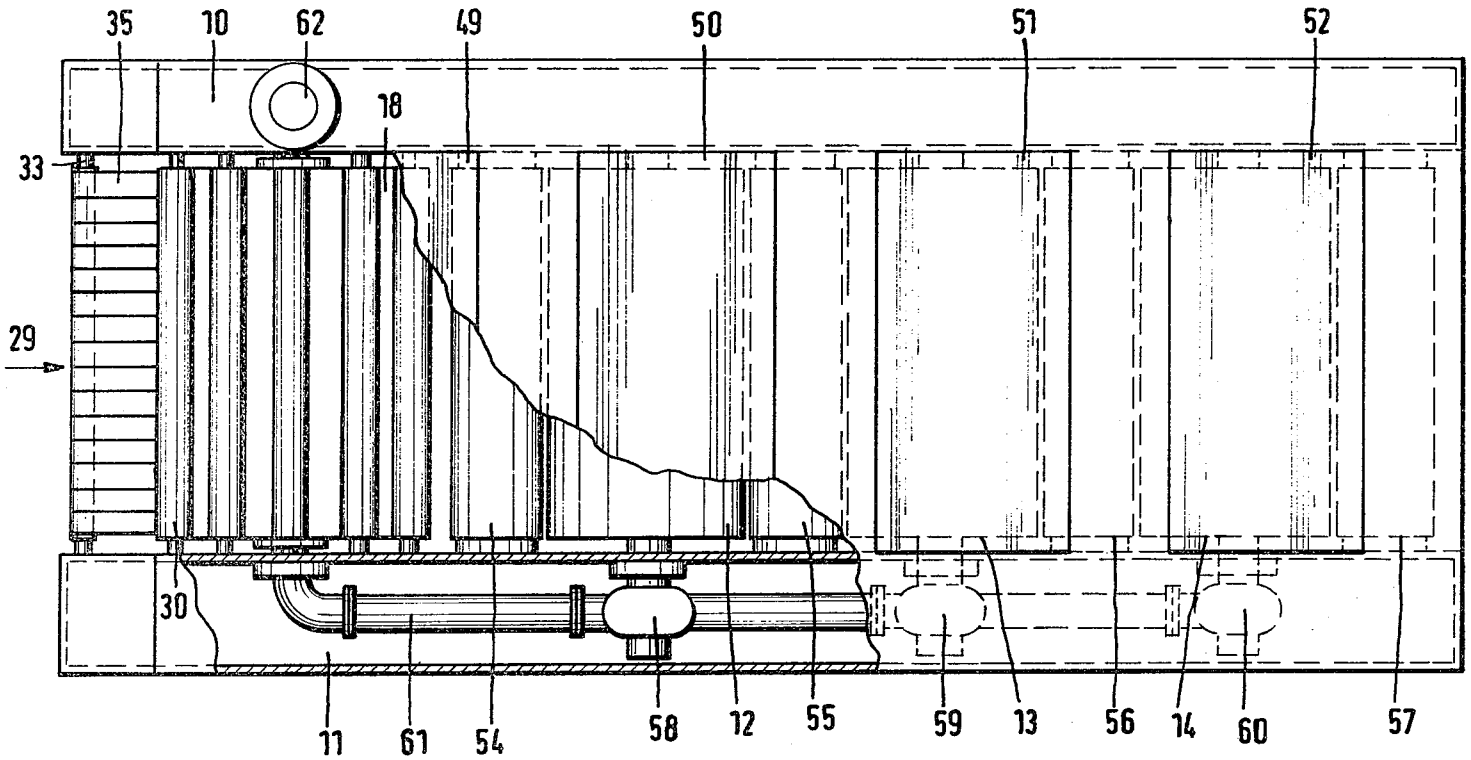
FIG. 2 shows a top view of the mangle of FIG. 1.

With the mangle of FIGS. 1 and 2 the steam and used air which accumulates on and inside drums 12–14 is evacuated by fans 58, 59, 60 mounted on the hollow bearings of the drums and fed through the exhaust conduit 61 into the hollow cylinder 18 and, although not shown, into the guide manifolds 46, 47. The cylinder 18 has a hollow bearing neck on the feed side. The removal of the used air from cylinder 18 takes place through a hollow bearing neck on the other side which is coupled to an exhaust conduit 62. The steam supplies to and condensate exhausts from the troughs 15, 16, 17, the bridges 54, 55 and 56 and the manifolds 46, 47 are not shown in FIGS. 1 and 2.

Figure 3:
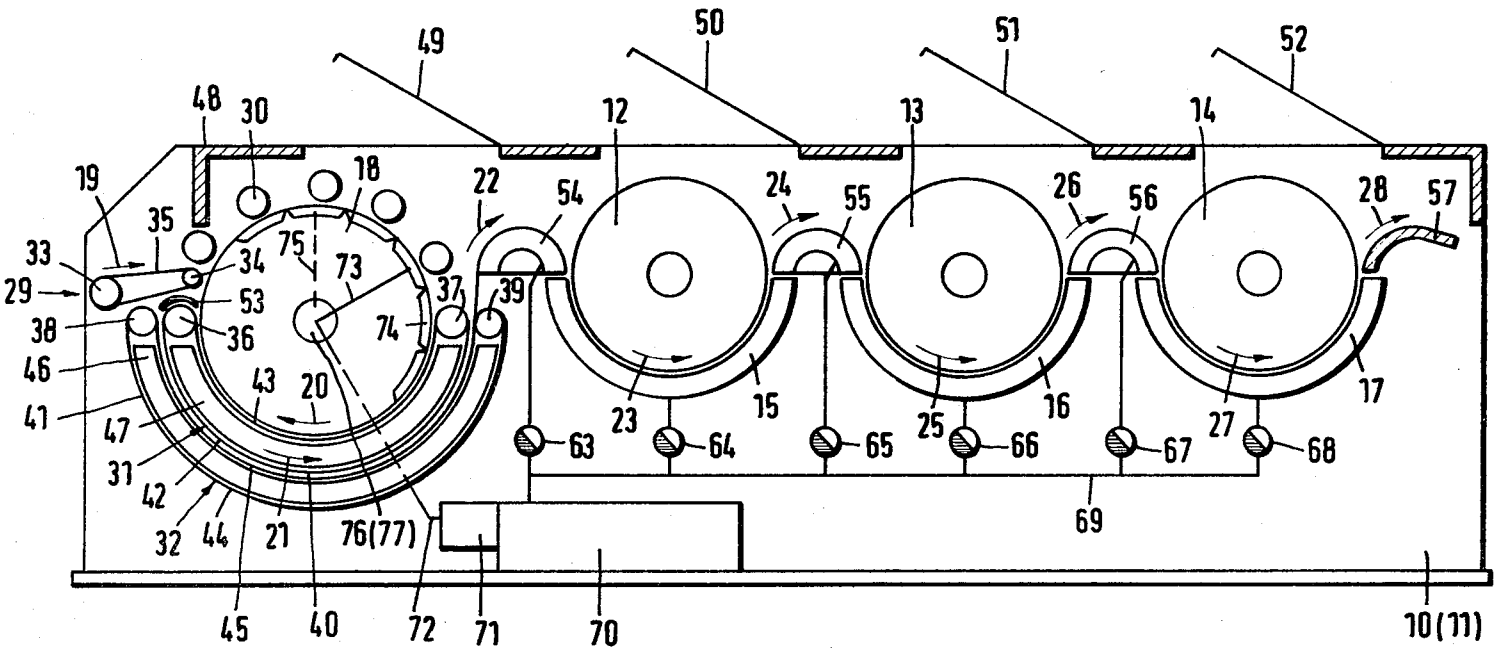
FIG. 3 shows a longitudinal sectional view through a mangle with a hollow cylinder heated by condensate.

With the mangle according to FIG. 3 special condensate removal lines 63–68 are provided. The condensate which accumulates in these lines is taken through a collection lead 69 to a container 70. From this container the condensate is fed by a pump 71 and lines 72, 73 to a shallow chamber 74 located around the inner periphery of the cylinder 18, which is only partially shown in the drawings. The lines 72, 73 pass through a bore in the hollow bearing 76 of the cylinder. The coupling between lines 72, 73 has a rotating joint in the area of the bearing 76. A line 75 on the other side of the cylinder 18 removes the used condensate from chamber 74 through the hollow bearing 77 via a further rotating joint. The supply and removal of condensate to and from the manifolds 46, 47 is not shown in the drawing.

A cover extending between stands 10, 11 with lids 49–52 is arranged above and thus encloses drums 12, 13, 14, the cylinder 18 and the bridges 54, 55, 56.

The mangles according to FIGS. 1 through 3 have in addition all needed and known but not illustrated devices and parts necessary for operation. For example, the mangle in FIG. 3 also has an electric control device with a float switch in the container 70 which controls the pump 71.

The operation of the mangle is as follows:

The laundry articles, not shown, are delivered to infeed 29 either by hand or by an automatic feeder and are conveyed through the apparatus in the direction of arrows 19–28. The articles are first fed through the pre-dryer, which consists of the heated cylinder 18 and manifolds 46, 47, over a frictionless, elongated transport path defined between the heated surfaces of the cylinder 18 and manifolds 46, 47. The frictionless conveyance of the articles, due to the cylinder 18 and the bands 40, 41 being driven at the same peripheral speeds, prevents blockages and wrinkles from occurring. The laundry articles leave the pre-dryer and slide through mangle bonds, not shown, and over the heated diverter bridge 54 to the first drum/trough unit 12, 15 and from there in a known manner through the rest of the mangle.

As a result of the pre-drying of the laundry articles, at the first drum/trough unit, in contrast to mangles which lack this pre-drying and in which approximately 40% of the moisture must be removed here, considerably less is removed. This lower evaporation at the first drum/trough unit leads, with the same output of the mangle, to a comparably reduced vaporization output compared to the total of the three drum/trough units, and thus enables the output of the mangle to be increased. In both cases, i.e. the heating of the cylinder 18 and the manifolds 46, 47 by the exhaust air removed from the drum/trough units (FIGS. 1 and 2) or by the condensate from troughs 15–17 and the diverter bridges 54–56 (FIG. 3), there is considerable energy saving relative to the vaporization output of the mangles resulting from the dampness of the laundry articles.

Since the amount of condensate accumulating in the steam heated troughs 15–17 and diverter bridges 54–56 is dependent on diverse factors, where the accumulation of condensate is not adequate it is advisable to heat the manifolds 46, 47 of the pre-dryer with steam and to also use the accumulated condensate therefrom to heat the cylinder 18. It is also possible to feed condensate occurring from other steam consuming installations in the laundry to the collection container 70.

What is claimed is:

1. A mangle for pressing and drying damp laundry articles including a plurality of rotatably mounted, padded, perforated hollow drums attached to a vacuum device, and an equal plurality of cooperable, perforated, curved hollow troughs which define transport paths with the drums and which are heated by high pressure steam, characterized by: a rotatably mounted hollow imperforate pre-dryer cylinder (18) disposed in front of the drums (12–14) in the operating direction, means for heating the cylinder with used steam condensate withdrawn from the troughs, and means for conveying the laundry articles around and in frictionless contact with the outer wall of the cylinder.

2. A mangle according to claim 1, characterized by chambers (74) on the interior surface of the cylinder, hollow bearing necks (76, 77) on the cylinder, and condensate supply and removal lines (72, 73, 75) led through the hollow bearing necks to the chambers and away from them, respectively.

3. A mangle according to claim 2 wherein the condensate from the troughs is supplied to the lines (72, 73) leading to the chambers via a collection container (70) and a pump (71).

4. A mangle according to claim 1, wherein pressure rollers (30) are mounted adjacent the outer wall of the cylinder and guide the laundry articles over and press them against the cylinder.

5. A mangle according to claim 1, wherein a first curved pressure transport band (40) is mounted adjacent the outer wall of the cylinder and is driven at the same speed and in the same direction as the cylinder to guide the laundry articles and press them against the cylinder.

6. A mangle according to claim 5, characterized by a second curved pressure transport band (41) mounted adjacent and outwardly of the first band to define a reverse guide path between the bands opposite to the direction of the cylinder rotation.

7. A mangle according to claim 5, further comprising a pair of hollow curved manifolds (46, 47) individually mounted between the two transport bands.

8. A mangle according to claim 6, further comprising a pair of hollow curved manifolds (46, 47) individually mounted between the two transport bands.

9. A mangle for pressing and drying damp laundry articles including a plurality of rotatably mounted, padded, perforated hollow drums attached to a vacuum device, and an equal plurality of cooperable, perforated, curved hollow troughs which define transport paths with the drums and which are heated by high pressure steam, characterized by: a rotatably mounted hollow imperforate pre-dryer cylinder (18) disposed is front of the drums (12–14) in the operating direction, means for heating the cylinder with used hot air withdrawn from the drums, and means for conveying the laundry articles around and in frictionless contact with the outer wall of the cylinder.

10. A mangle according to claim 1, wherein pressure rollers (30) are mounted adjacent the outer wall of the cylinder and guide the laundry articles over and press them against the cylinder.

11. A mangle according to claim 1, wherein a first curved pressure transport band (40) is mounted adjacent the outer wall of the cylinder and is driven at the same speed and in the same direction as the cylinder to guide the laundry articles and press them against the cylinder.

12. A mangle according to claim 11, characterized by a second curved pressure transport band (41) mounted adjacent and outwardly of the first band to define a reverse guide path between the bands opposite to the direction of the cylinder rotation.

13. A mangle according to claims 11 or 12, further comprising a pair of hollow curved manifolds (46, 47) individually mounted between the two transport bands.

* * * * *